US010281874B2

(12) United States Patent
Shigemori et al.

(10) Patent No.: US 10,281,874 B2
(45) Date of Patent: May 7, 2019

(54) TERMINAL CONTACT STRUCTURE FOR REMOVABLE BODY AND IMAGE FORMING APPARATUS HAVING THE SAME

(71) Applicant: FUJI XEROX Co., Ltd., Tokyo (JP)

(72) Inventors: Kohyu Shigemori, Kanagawa (JP); Tsutomu Komiyama, Kanagawa (JP); Kaoru Matsushita, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/903,378

(22) Filed: Feb. 23, 2018

(65) Prior Publication Data

US 2018/0267460 A1 Sep. 20, 2018

(30) Foreign Application Priority Data

Mar. 15, 2017 (JP) ..... 2017-049933

(51) Int. Cl.
*G03G 21/18* (2006.01)

(52) U.S. Cl.
CPC ... *G03G 21/1871* (2013.01); *G03G 2221/166* (2013.01); *G03G 2221/183* (2013.01)

(58) Field of Classification Search
CPC ..... G03G 21/1871
USPC ..... 399/90
See application file for complete search history.

(56) References Cited

U.S. PATENT DOCUMENTS 7,474,863 B2 1/2009 Kaiga
2003/0123896 A1* 7/2003 Goto ..... G03G 21/1871 399/90

FOREIGN PATENT DOCUMENTS

JP 2004-061595 A 2/2004
JP 2007-121746 A 5/2007
JP 2011-180309 A 9/2011

* cited by examiner

*Primary Examiner* — Quana Grainger
(74) *Attorney, Agent, or Firm* — Sughrue Mion, PLLC

(57) ABSTRACT

A terminal contact structure includes a first terminal provided on a removable body; a second terminal provided on an apparatus body in which the removable body is inserted, the second terminal not being in contact with the first terminal when the removable body is in a removable state, the second terminal being in contact with the first terminal when the removable body is in a fixed state; and a guide member provided on the apparatus body and having a first surface and a second surface, the first surface guiding the first terminal in an insertion direction in which the removable body is inserted, the second surface guiding the second terminal in a contact direction in which the second terminal comes into contact with the first terminal, the contact direction being a crossing direction that crosses the insertion direction.

12 Claims, 7 Drawing Sheets

TERMINAL CONTACT STRUCTURE FOR REMOVABLE BODY AND IMAGE FORMING APPARATUS HAVING THE SAME

CROSS-REFERENCE TO RELATED APPLICATIONS

This application is based on and claims priority under 35 USC 119 from Japanese Patent Application No. 2017-049933 filed Mar. 15, 2017.

BACKGROUND

Technical Field

The present invention relates to a terminal contact structure and an image forming apparatus.

SUMMARY

According to an aspect of the invention, there is provided a terminal contact structure including a first terminal provided on a removable body; a second terminal provided on an apparatus body in which the removable body is inserted, the second terminal not being in contact with the first terminal when the removable body is in a removable state, the second terminal being in contact with the first terminal when the removable body is in a fixed state; and a guide member provided on the apparatus body and having a first surface and a second surface, the first surface guiding the first terminal in an insertion direction in which the removable body is inserted, the second surface guiding the second terminal in a contact direction in which the second terminal comes into contact with the first terminal, the contact direction being a crossing direction that crosses the insertion direction.

BRIEF DESCRIPTION OF THE DRAWINGS

An Exemplary embodiment of the present invention will be described in detail based on the following figures, wherein:

FIG. 7A illustrates the state in which the photoconductor unit is being inserted, FIG. 7B illustrates the state in which the terminal unit is lowered, and FIG. 7C illustrates the state in which the terminal unit is raised.

DETAILED DESCRIPTION

An exemplary embodiment of the present invention will now be described with reference to the drawings.

Image Forming Apparatus

Figure 1:
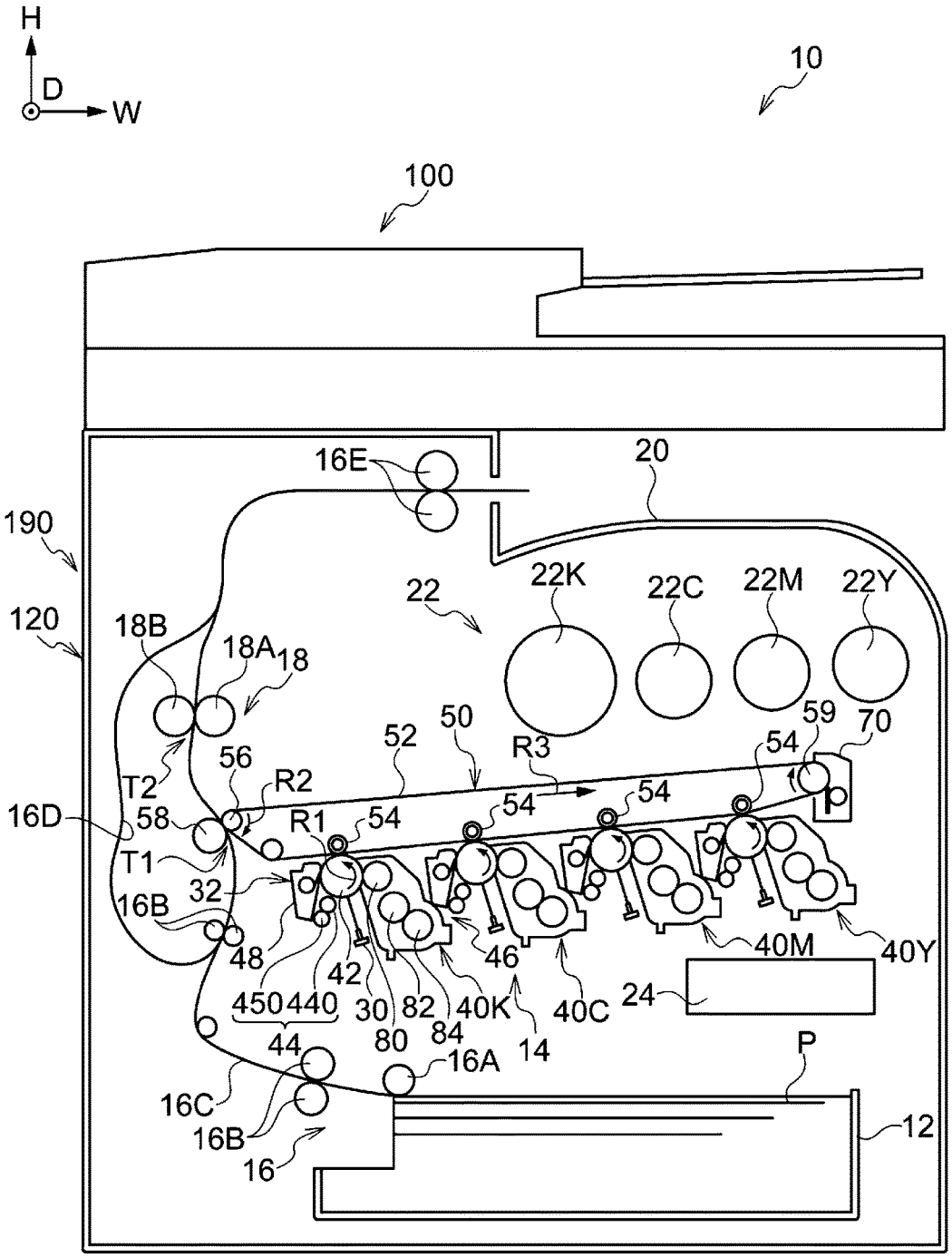
FIG. 1 illustrates the structure of an image forming apparatus including a terminal contact structure according to an exemplary embodiment.

FIG. 1 illustrates an exemplary structure of an image forming apparatus 10 including a terminal contact structure 200S according to the present exemplary embodiment. In the following description, the direction indicated by arrow H in FIG. 1 will be referred to as an apparatus height direction, the direction indicated by arrow W as an apparatus width direction, and the direction perpendicular to the apparatus height direction and the apparatus width direction (indicated by arrow D) as an apparatus depth direction.

As illustrated in FIG. 1, the image forming apparatus 10 includes an image reading unit 100 and an image forming unit 190. The image reading unit 100 reads an image of an original document and outputs image data representing the read image. The image forming unit 190 forms an image on a recording medium on the basis of the image data.

The image forming unit 190 is disposed in a housing 120 of the image forming apparatus 10, and includes a recording-sheet storage unit 12 that stores recording sheets P, which serve as recording media, a toner-image forming section 14, a transport unit 16, a fixing device 18, a discharging unit 20, a supplying mechanism 22, and a controller 24. The housing 120 is an example of an "apparatus body".

The toner-image forming section 14 includes image forming units 40Y, 40M, 40C, and 40K and a transfer unit 50. Yellow (Y), magenta (M), cyan (C), and black (K) are examples of toner colors.

The image forming units 40Y, 40M, 40C, and 40K have similar structures except for the toner used therein. Accordingly, in FIG. 1, reference numerals for the components of the image forming units 40Y, 40M, and 40C are omitted.

The image forming unit 40K includes an image carrier 42K, a charging device 44K, an exposure device 30K, a developing device 46K, and a removing device 48K. Similarly, the image forming units 40Y, 40M, and 40C respectively include image carriers 42Y, 42M, and 42C, charging devices 44Y, 44M, and 44C, exposure devices 30Y, 30M, and 30C, developing devices 46Y, 46M, and 46C, and removing devices 48Y, 48M, and 48C, which correspond to the respective colors. In the following description, when it is not necessary to distinguish between the image forming units 40Y, 40M, 40C, and 40K and their components for the respective toner colors (Y, M, C, and K), the letters 'Y', 'M', 'C', and 'K' attached to the reference numerals are omitted.

The image forming units 40Y, 40M, 40C, and 40K respectively form yellow (Y), magenta (M), cyan (C), and black (K) toner images on the outer peripheral surfaces of the image carriers 42Y, 42M, 42C, and 42K. The image forming units 40Y, 40M, 40C, and 40K are arranged next to each other so that the image forming units 40 are aligned at an angle with respect to the apparatus width direction.

In each image forming unit 40, the image carrier 42, the charging device 44, and the removing device 48 are integrated together into a sub-cartridge, which serves as a photoconductor unit 32. The photoconductor unit 32 is removably attached to the housing 120 of the image forming apparatus 10. The state in which the photoconductor unit 32 is removable from the housing 120 is referred to as a removable state, and the state in which the photoconductor unit 32 is fixed to the housing 120 is referred to as a fixed state. The photoconductor unit 32 is an example of a "removable body" and an "image forming apparatus unit".

The image carrier 42 has a function of carrying a toner image developed by the developing device 46. The image carrier 42 has a cylindrical shape, and is rotated around an axis thereof (in the direction of arrow R1) by a driving unit (not shown). The image carrier 42 includes, for example, a base material made of aluminum and a photosensitive layer (not shown) provided on the base material. The photosensitive layer includes an undercoat layer, a charge generating layer, and a charge transport layer arranged in that order.

The charging device 44 has a function of charging the outer peripheral surface of the image carrier 42. The charging device 44 extends in the axial direction of the image carrier 42 (apparatus depth direction). The charging device 44 includes a charging roller 440 and a cleaning roller 450. A voltage required to charge the outer peripheral surface of the image carrier 42 is applied to a shaft (not shown) of the charging roller 440. The cleaning roller 450 removes toner, external additives, paper powder, and impurities, such as dust, that have adhered to the outer peripheral surface of the charging roller 440.

The exposure device 30 has a function of forming a latent image on the outer peripheral surface of the image carrier 42 charged by the charging device 44. The exposure device 30 emits exposure light from, for example, a light emitting diode array (not shown) on the basis of the image data received from an image-signal processing unit (not shown) included in the controller 24. The exposure light irradiates the outer peripheral surface of the image carrier 42 charged by the charging device 44, and thereby forms a latent image on the outer peripheral surface.

The developing device 46 has a function of developing the latent image formed on the image carrier 42 into a toner image. The developing device 46 extends in the axial direction of the image carrier 42. The developing device 46 includes a toner supplying body 80, which supplies toner to the outer peripheral surface of the image carrier 42, and two transport members 82 and 84, which transport developer containing the toner and carrier to the toner supplying body 80.

The toner image formed on the outer peripheral surface of the image carrier 42 is transferred onto a transfer belt 52 in a first transfer process. After the first transfer process, the toner, external additives, etc., remain on the outer peripheral surface of the image carrier 42. The removing device 48 has a function of removing the remaining toner, external additives, etc., from the outer peripheral surface of the image carrier 42.

Toner images of respective colors are developed on the outer peripheral surfaces of the respective image carriers 42 by the respective developing devices 46. The transfer unit 50 has a function of performing the first transfer process on each of the toner images and then performing a second transfer process in which the toner images are transferred onto a recording sheet P. The transfer unit 50 includes the transfer belt 52, first transfer rollers 54 of the respective colors, a driving roller 56, and a second transfer roller 58.

The transfer belt 52 is an endless belt. The first transfer rollers 54 and the driving roller 56 are in contact with the inner peripheral surface of the transfer belt 52. The position of the transfer belt 52 is determined by, for example, the four first transfer rollers 54, the driving roller 56, and a tension-applying roller 59, which are in contact with the inner peripheral surface thereof, and is at an angle with respect to the apparatus width direction when viewed from the front. In the transfer unit 50, a portion of the outer peripheral surface of the transfer belt 52 that faces downward in the apparatus height direction is in contact with the outer peripheral surfaces of the image carriers 42 included in the image forming units 40, which are aligned at an angle with respect to the apparatus width direction.

When the driving roller 56 is rotated around an axis thereof (in the direction of arrow R2) by a drive source (not shown), the driving roller 56 applies a frictional force to a portion of the transfer belt 52 that is wound around the outer peripheral surface of the driving roller 56. Accordingly, the driving roller 56 rotates the transfer belt 52 in the direction of arrow R3.

Each first transfer roller 54 is offset downstream in the rotation direction of the transfer belt 52 (direction of arrow R3) from an imaginary straight line that extends in the apparatus height direction through the axial center of a corresponding image carrier 42 that opposes the first transfer roller 54 with the transfer belt 52 interposed therebetween. Thus, the transfer belt 52 rotates while being in contact with the outer peripheral surfaces of the image carriers 42.

When a first transfer voltage is applied to the first transfer rollers 54, the first transfer rollers 54 transfer the toner images formed on the outer peripheral surfaces of the image carriers 42Y, 42M, 42C, and 42K onto the outer peripheral surface of the transfer belt 52 in the first transfer process.

The second transfer roller 58 is a long roller. In an image forming operation, the second transfer roller 58 is pressed by a pressing unit (not shown) to form a nip part (second transfer position T1) between the second transfer roller 58 and the transfer belt 52. When a second transfer voltage is applied to the second transfer roller 58, the second transfer roller 58 transfers the toner images that have been transferred to the outer peripheral surface of the transfer belt 52 in the first transfer process onto the recording sheet P in the second transfer process. The recording sheet P is transported along a transport path 16C, which will be described below, and passes through the second transfer position T1.

After the second transfer process, in which the toner images that have been transferred to the outer peripheral surface of the transfer belt 52 in the first transfer process are transferred to the recording sheet P, the toner, external additives, etc., remain on the outer peripheral surface of the transfer belt 52. The cleaning device 70 has a function of removing the remaining toner, external additives, etc., from the outer peripheral surface of the transfer belt 52.

The supplying mechanisms 22Y, 22M, 22C, and 22K have a function of supplying developers to the developing devices 46Y, 46M, 46C, and 46K.

The transport unit 16 has a function of transporting the recording sheets P stored in the recording-sheet storage unit 12 to the discharging unit 20, which will be described below. The transport unit 16 includes a feed roller 16A, plural pairs of transport rollers 16B, a reversing transport unit 16D, and discharge rollers 16E, which will be described below.

The reversing transport unit 16D of the transport unit 16 transports the recording sheet P while reversing the recording sheet P so that images may be formed on both sides of the recording sheet P. The reversing transport unit 16D transports the recording sheet P having the toner images fixed to the front side thereof in a switchback manner. Then, the reversing transport unit 16D transports the recording sheet P to the second transfer position T1 so that the back side of the recording sheet P faces the outer peripheral surface of the transfer belt 52.

The fixing device 18 has a function of fixing the toner images that have been transferred to the recording sheet P in the second transfer process to the recording sheet P. The fixing device 18 includes a fixing roller 18A and a pressing roller 18B.

The discharging unit 20 is located downstream of the fixing device 18 in the direction in which the recording sheet P is transported, and is formed on a portion of an upper external surface of the housing 120. The recording sheet P to which the toner images are fixed is discharged to the discharging unit 20 by the discharge rollers 16E.

An image forming operation of the image forming unit 190 will be described with reference to FIG. 1.

When, for example, the controller 24 receives an image signal from an external device (not shown), such as a personal computer, the controller 24 activates the image forming apparatus 10. The controller 24 converts the image signal into yellow (Y), magenta (M), cyan (C), and black (K) image data components (image information). The image data components are output to the exposure devices 30.

Then, exposure light is emitted from the exposure devices 30 on the basis of the image data components of the respective colors, and is incident on the outer peripheral surfaces of the image carriers 42 charged by the charging devices 44. Thus, latent images corresponding to the image data components of the respective colors are formed on the outer peripheral surfaces of the image carriers 42.

The latent images formed on the outer peripheral surfaces of the image carriers 42 are developed into toner images of the respective colors by the developing devices 46.

The toner images of the respective colors on the outer peripheral surfaces of the image carriers 42 are transferred onto the outer peripheral surface of the transfer belt 52 by the first transfer rollers 54, which oppose the image carriers 42, in the first transfer process.

The recording sheet P is fed from the recording-sheet storage unit 12 and transported to the second transfer position T1 at a time corresponding to the time at which a portion of the outer peripheral surface of the transfer belt 52 to which the toner images have been transferred in the first transfer process is transported to the second transfer position T1 by the rotation of the transfer belt 52. When the recording sheet P passes through the second transfer position T1, the toner images that have been transferred to the outer peripheral surface of the transfer belt 52 in the first transfer process are transferred onto the recording sheet P in the second transfer process.

Subsequently, the recording sheet P to which the toner images have been transferred is transported to the fixing device 18. Then, the toner images are heated and pressed by the fixing roller 18A and the pressing roller 18B of the fixing device 18, and are thereby fixed to the recording sheet P.

The recording sheet P to which the toner images are fixed is discharged to the discharging unit 20. Thus, the image forming operation is finished.

Terminal Contact Structure

The terminal contact structure 200S according to the present exemplary embodiment will now be described with reference to FIG. 2 to FIGS. 7A to 7C.

Basic Structure of Photoconductor Unit

Figure 2:
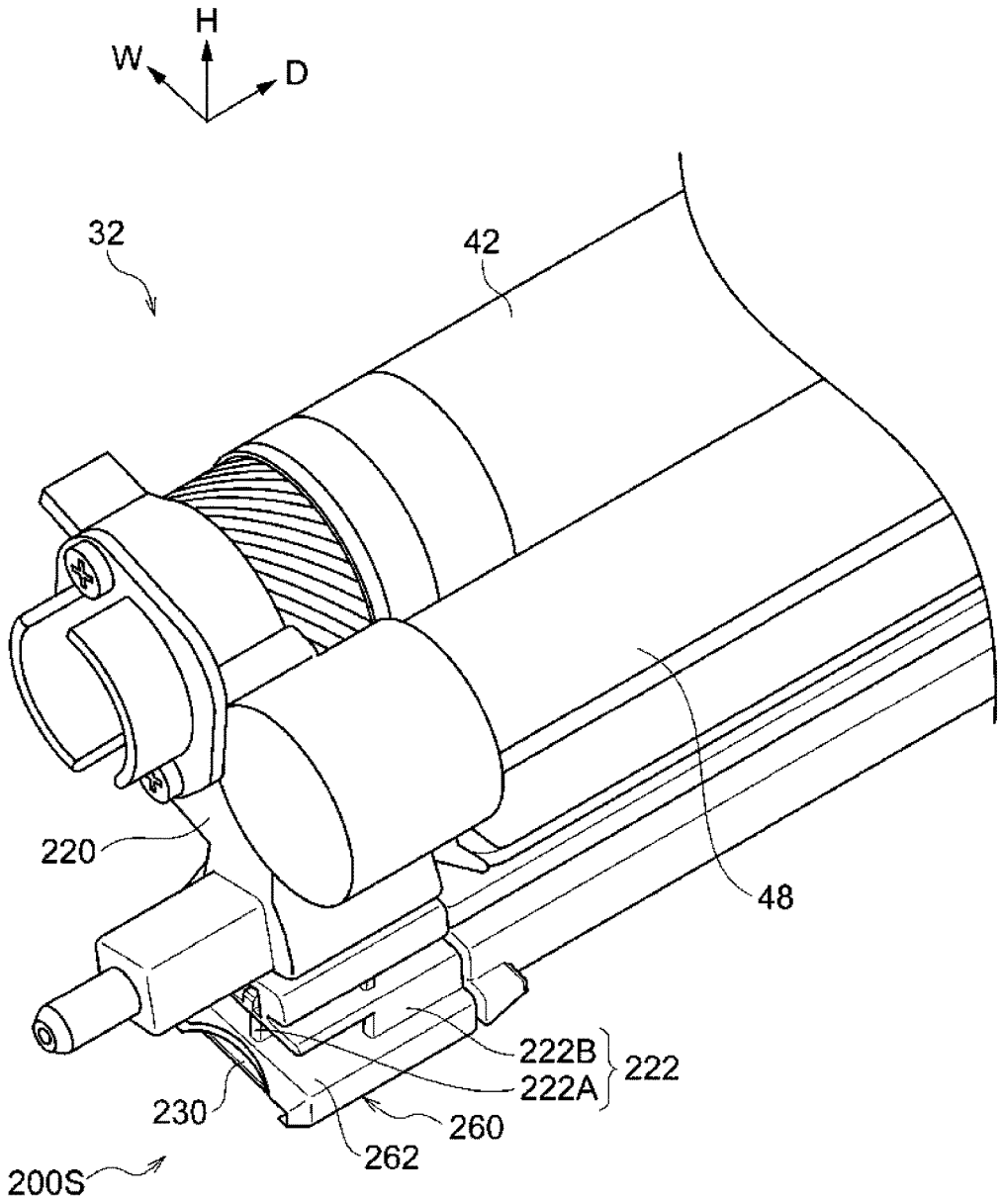
FIG. 2 is a perspective view of a photoconductor unit provided with the terminal contact structure according to the exemplary embodiment viewed from above.
Figure 3:
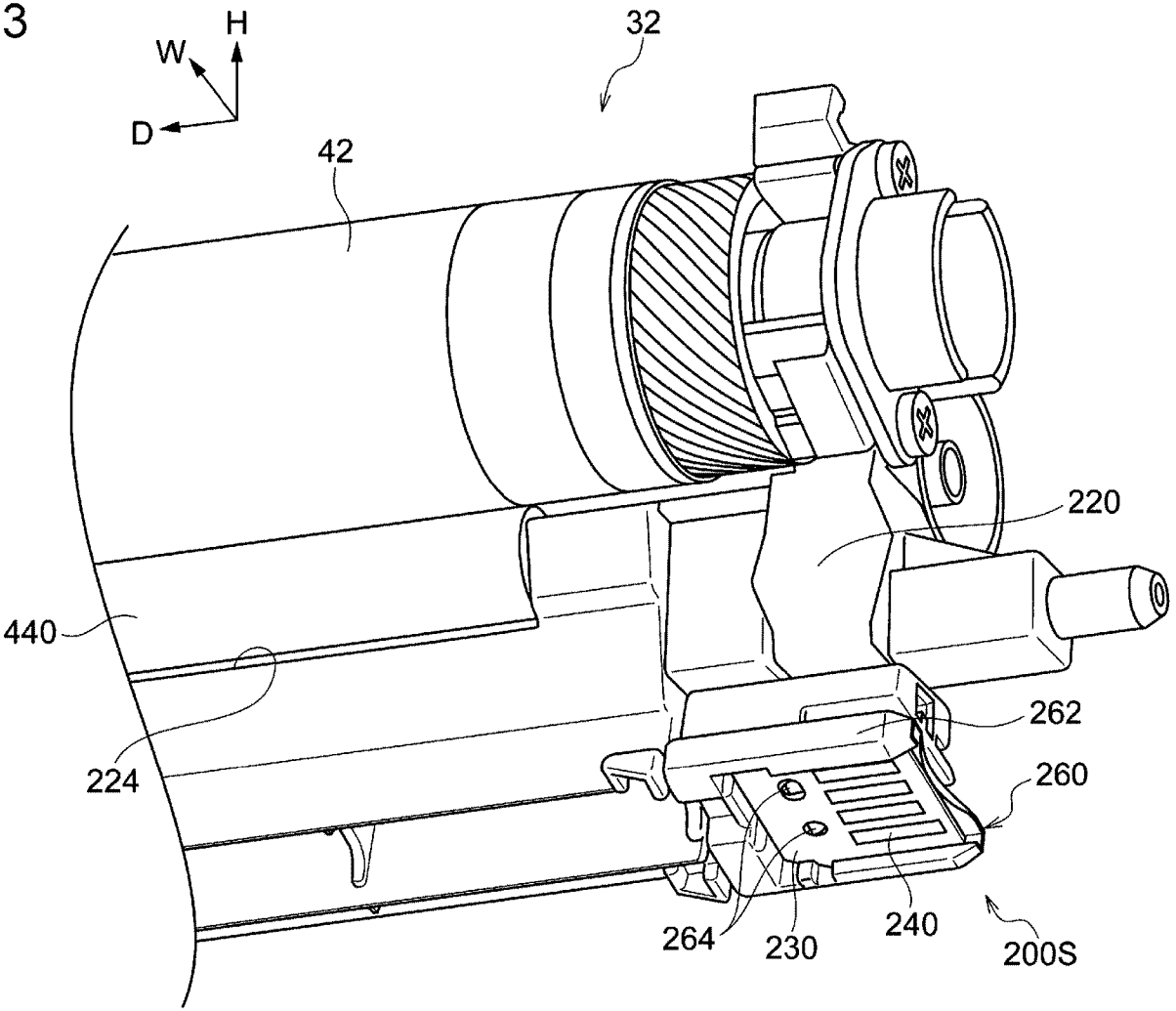
FIG. 3 is a perspective view of the photoconductor unit provided with the terminal contact structure according to the exemplary embodiment viewed from below.

FIG. 2 is a perspective view of a back portion of a photoconductor unit 32 in the apparatus depth direction, viewed from above in the apparatus height direction. The photoconductor unit 32 is provided with the terminal contact structure 200S. FIG. 3 is a perspective view of the back portion of the photoconductor unit 32 viewed from below in the apparatus height direction. As illustrated in FIGS. 2 and 3, the photoconductor unit 32 includes a housing 220. The housing 220 has an opening 224 (see FIG. 3) that opens so as to face the toner supplying body 80 (see FIG. 1). The housing 220 is an example of a "body portion".

The housing 220 contains the roll-shaped image carrier 42, the charging roller 440, and the cleaning roller 450 (see FIG. 1). The image carrier 42 is disposed at the opening 224 that faces the toner supplying body 80. The charging roller 440, which is in contact with the image carrier 42, is disposed below the image carrier 42 in the apparatus height direction. The cleaning roller 450, which cleans the charging roller 440, is disposed below the charging roller 440 in the apparatus height direction.

The housing 220 also contains the removing device 48. The removing device 48 is on the left side (right side in FIG. 2) of the image carrier 42 in the apparatus width direction. The removing device 48 removes the toner, external additives, etc., that remain on the outer peripheral surface of the image carrier 42 after the first transfer process from the outer peripheral surface of the image carrier 42. Although not illustrated, the removing device 48 includes a blade that extends in the axial direction of the image carrier 42 and that is in contact with the outer peripheral surface of the image carrier 42, and a transport roller that transports the toner and the like removed by the blade.

Holder Portion

Figure 5:
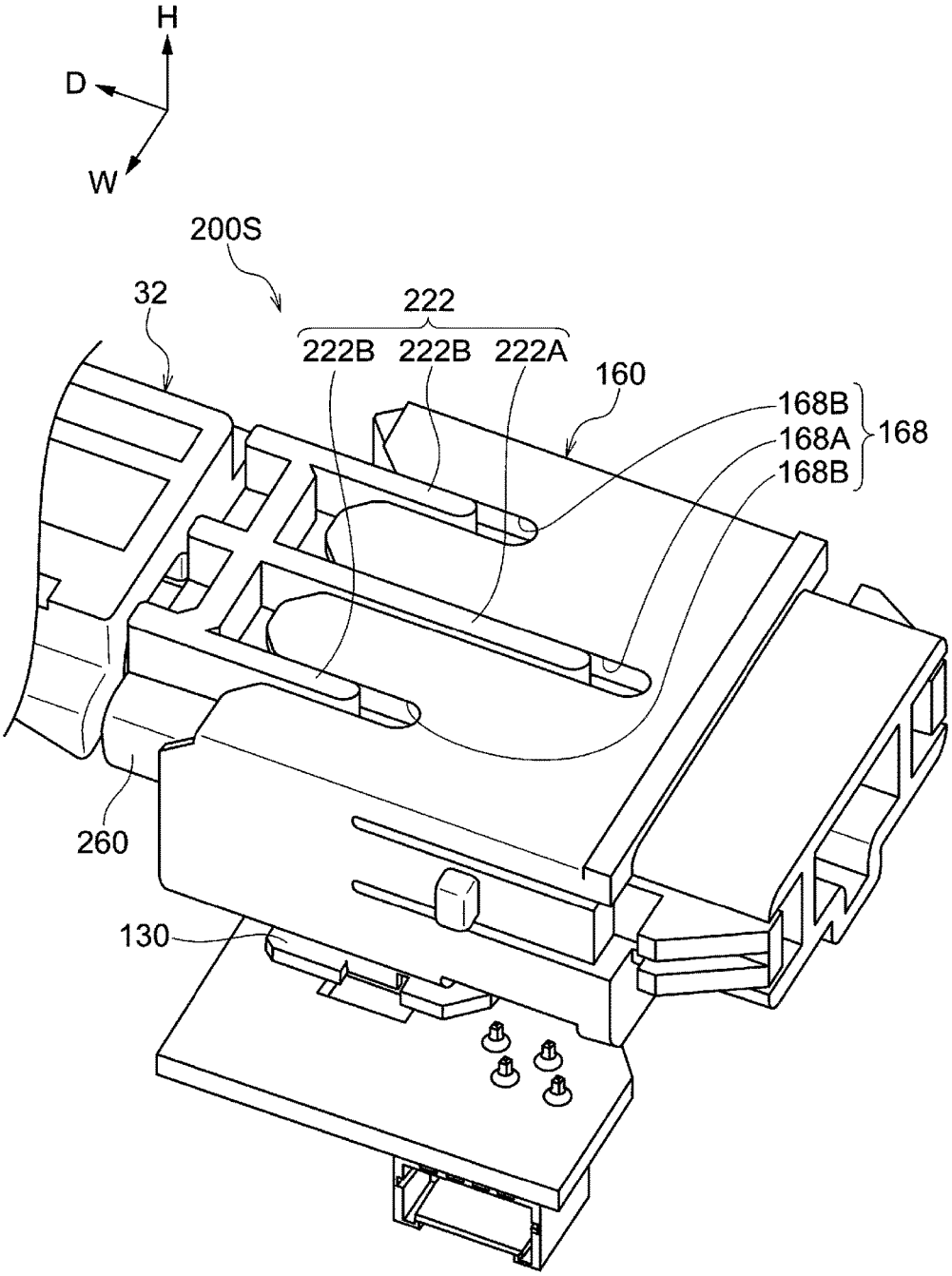
FIG. 5 is a perspective view illustrating the relationship between ribs and groove portions included in the terminal contact structure according to the exemplary embodiment.

A holder portion 260 is provided at the back of the photoconductor unit 32 in the apparatus depth direction and at the bottom of the photoconductor unit 32 in the apparatus height direction. The holder portion 260 holds a customer replaceable unit memory (CRUM) 230 including a substrate terminal 240, which will be described below. The holder portion 260 is an example of a "holder". The holder portion 260 is connected to plural ribs 222, which extend downward from the housing 220 and which also extend in the apparatus depth direction. As illustrated in FIG. 5, the ribs 222 include a central rib 222A provided at the center in the apparatus width direction and side ribs 222B provided on both sides of the central rib 222A in the apparatus width direction. The side ribs 222B are shorter than the central rib 222A. For convenience of description, the housing 220 is omitted in FIG. 5.

As illustrated in FIGS. 2 and 3, the holder portion 260 is longer in the apparatus width direction and the apparatus depth direction than in the apparatus height direction. The holder portion 260 holds the CRUM 230 by supporting the CRUM 230 from below at both sides of the CRUM 230 in the apparatus width direction and restraining movement of the CRUM 230 in the apparatus depth direction with pins 264 (see FIG. 3).

The photoconductor unit 32 according to the present exemplary embodiment includes the CRUM 230, which stores service life parameters, such as the accumulated number of revolutions of the image carrier 42 and the accumulated number of sheets on which images are printed, and specific information used to identify, for example, the type of developer used in the developing device 46. The CRUM 230 is used to determine the service life of the image carrier 42. The information stored in the CRUM 230 may be information based on which the service life of the image carrier 42 may be determined. For example, the information may include not only the accumulated number of revolutions of the image carrier 42 and the accumulated number of sheets on which images are printed but also the accumulated number of pixels of the image data, the accumulated operating time of the developing device 14, and the accumulated amount of toner supplied to the developing device 46.

The substrate terminal 240, which includes plural electrodes, is provided on the bottom surface of the CRUM 230 in the apparatus height direction. The substrate terminal 240 includes four electrodes that are arranged in the apparatus width direction. The substrate terminal 240 is electrically connectable to an apparatus body terminal 140, which will be described below, by coming into contact therewith.

As described above, the photoconductor unit 32 according to the present exemplary embodiment is provided with the substrate terminal 240. The substrate terminal 240 is held by the holder portion 260. The holder portion 260 is received by a receiving portion 160, which will be described below, when the photoconductor unit 32 is inserted into the housing 120. The substrate terminal 240 is an example of a "first terminal".

Receiving Portion

Figure 4:
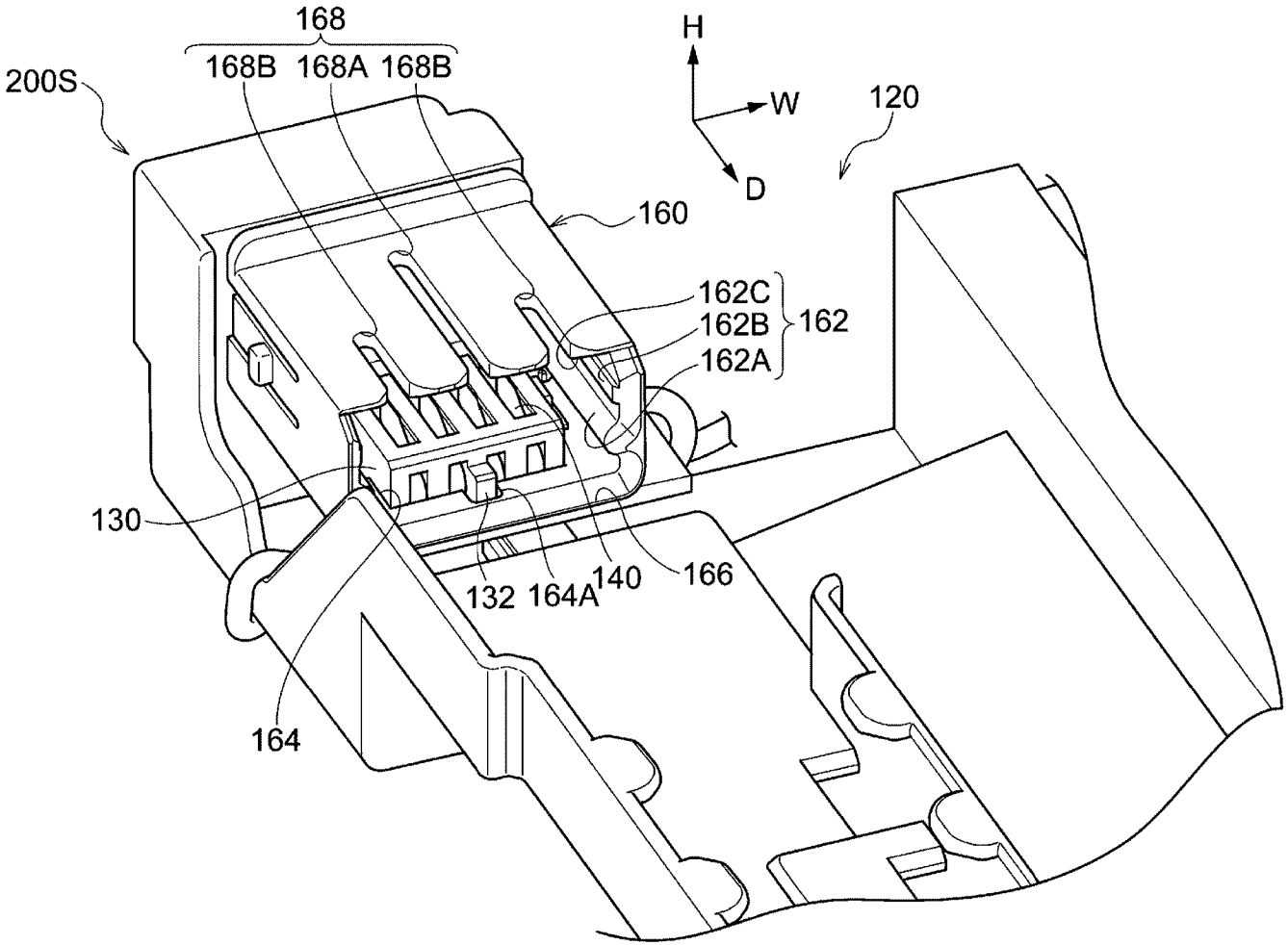
FIG. 4 is a perspective view of a receiving portion of the terminal contact structure according to the exemplary embodiment viewed from above.

FIG. 4 is a perspective view of a back section of the housing 120 in the apparatus depth direction, viewed from above in the apparatus height direction. The photoconductor unit 32 is inserted into the housing 120. As illustrated in FIG. 4, the receiving portion 160 for receiving the holder portion 260 is provided at the back of the housing 120 in the apparatus depth direction. The receiving portion 160 is provided for the holder portion 260 of each of the photoconductor units 32 of the respective toner colors. In other words, in the present exemplary embodiment, four receiving portions 160 are arranged in the apparatus width direction (see FIG. 6), and the receiving portions 160 include four sets of components. A terminal unit 130 having the apparatus body terminal 140 is disposed in each receiving portion 160. The receiving portions 160 are an example of a "guide member".

Each receiving portion 160 is a box-shaped member having an opening 166 at the front in the apparatus depth direction and plural groove portions 168, which extend in the apparatus depth direction, at the top in the apparatus height direction. As illustrated in FIG. 5, the groove portions 168 include a central groove portion 168A provided at the center in the apparatus width direction and side groove portions 168B provided on both sides of the central groove portion 168A in the apparatus width direction. The side groove portions 168B are shorter than the central groove portion 168A. The opening 166 is an example of an "insertion hole", and the groove portions 168 are an example of a "groove".

As illustrated in FIG. 4, the receiving portion 160 has a guide surface 162 and a sliding surface 164 on inner wall surfaces thereof. The guide surface 162 is an example of a "first surface", and the sliding surface 164 is an example of a "second surface". The guide surface 162 has a function of guiding the substrate terminal 240 (holder portion 260) in the apparatus depth direction, which is an insertion direction in which the photoconductor unit 32 is inserted. The guide surface 162 includes a lower guide surface 162A, a side guide surface 162B, and an upper guide surface 162C, which respectively hold a lower portion, a side portion, and an upper portion of the holder portion 260. The lower guide surface 162A is formed as a portion of a semicylindrical outer peripheral surface that projects from a side wall surface of the receiving portion 160 in the apparatus width direction and that extends in the apparatus depth direction. The side guide surface 162B is formed as an end surface of a rib that projects from the side wall surface of the receiving portion 160 in the apparatus width direction and that extends in the apparatus depth direction. The upper guide surface 162C is formed as an inner surface of the upper wall of the receiving portion 160.

In the present exemplary embodiment, when the photoconductor unit 32 is inserted into the housing 120, the holder portion 260 is inserted into the receiving portion 160 through the opening 166. The holder portion 260 has an outer wall surface 262 that extends in the apparatus depth direction. The guide surface 162 comes into contact with the outer wall surface 262, and thereby guides the holder portion 260. The ribs 222 provided on the photoconductor unit 32 are inserted into the groove portions 168 formed in the receiving portion 160. More specifically, the central rib 222A is inserted into the central groove portion 168A, and the side ribs 222B are inserted into the side groove portions 168B (see FIG. 5).

The sliding surface 164 is formed as an inner wall surface of an opening provided at the bottom of the receiving portion 160 in the apparatus height direction (see FIG. 7A), and surrounds the terminal unit 130 having the apparatus body terminal 140. The sliding surface 164 comes into contact with the outer wall surface of the terminal unit 130, and thereby guides the terminal unit 130. More specifically, the sliding surface 164 has a function of guiding the terminal unit 130 having the apparatus body terminal 140 in the apparatus height direction, which is a crossing direction that crosses the insertion direction of the photoconductor unit 32, and which is also a contact direction in which the apparatus body terminal 140 comes into contact with the substrate terminal 240. The terminal unit 130 is fitted to the sliding surface 164, which surrounds the terminal unit 130, at a lowered position (see FIG. 7A) and a raised position (see FIG. 7C). The terminal unit 130 has a projecting portion 132 at the front thereof in the apparatus depth direction. The projecting portion 132 engages with a cut portion 164A formed in the sliding surface 164.

The apparatus body terminal 140 is provided on the housing 120, in which the photoconductor unit 32 is inserted, at the top of the terminal unit 130 in the apparatus height direction. More specifically, the apparatus body terminal 140 includes four electrodes that are arranged in the apparatus width direction. The electrodes of the apparatus body terminal 140 and the electrodes of the substrate terminal 240 are arranged at the same intervals. The electrodes of the apparatus body terminal 140 are formed of metal plates that project upward when viewed in the apparatus width direction (see FIG. 7A). The apparatus body terminal 140 having the above-described structure comes into contact with and electrically connected to the substrate terminal 240 when the terminal unit 130 is moved in the apparatus height direction. The apparatus body terminal 140 is an example of a "second terminal".

Raising-and-Lowering Mechanism for Terminal Units

Figure 6:
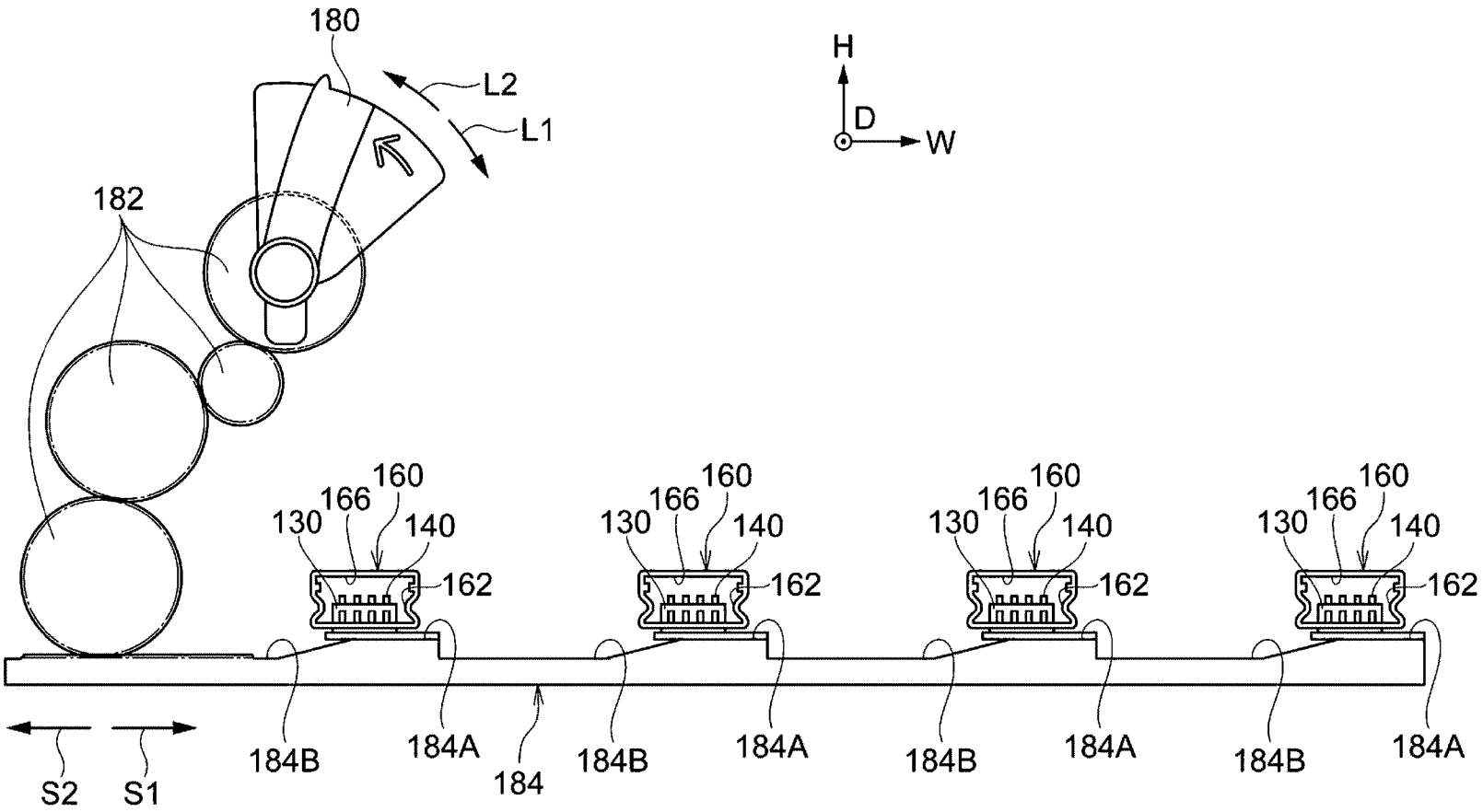
FIG. 6 is a diagram (front view) of a raising-and-lowering mechanism for terminal units included in the terminal contact structure according to the exemplary embodiment.

FIG. 6 illustrates a raising-and-lowering mechanism for the terminal units 130 included in the terminal contact structure 200S according to the present exemplary embodiment. As illustrated in FIG. 6, in the present exemplary embodiment, an operation lever 180 is provided at the front of the housing 120 in the apparatus depth direction. An operator operates the operation lever 180 to switch the photoconductor units 32 between the removable state and the fixed state. In the present exemplary embodiment, when the operation lever 180 is operated, the transfer belt 52 becomes separated from all of the four image carriers 42, so that the photoconductor units 32 are set to the removable state. Thus, in the present exemplary embodiment, the photoconductor units 32 and the developing units (developing devices 46) become removable when the operation lever 180 is operated to remove the transfer belt 52 from the image carriers 42. The operation lever 180 is an example of a "lever".

In addition to the function of removing the transfer belt 52 from the image carriers 42, the operation lever 180 of the present exemplary embodiment also has a function of vertically moving the terminal units 130 corresponding to the photoconductor units 32 of the respective toner colors in the apparatus height direction. More specifically, the operation lever 180 has a function of separating the substrate terminals 240 and the apparatus body terminals 140 from each other when operated to set the photoconductor units 32 to the removable state and bringing the substrate terminals 240 and the apparatus body terminals 140 into contact with each other when operated to set the photoconductor units 32 to the fixed state. The operation lever 180 is connected to a gear train 182, which is provided at the back of the housing 120 in the apparatus depth direction, by a shaft (not shown). As illustrated in FIG. 6, the gear train 182 is engaged with a linear cam 184. In the present exemplary embodiment, the linear cam 184 is linearly moved in response to the rotation of the operation lever 180. The linear cam 184 includes cam top portions 184A at a high position and cam bottom portions 184B at a low position. Each terminal unit 130 is in contact with a corresponding cam top portion 184A or a corresponding cam bottom portion 184B, which are operation surfaces of the linear cam 184.

When the operation lever 180 is operated, the terminal units 130 are moved in the following manner. Referring to FIG. 6, when the operation lever 180 is rotated in the L1 direction to set the photoconductor units 32 to the removable state, the linear cam 184 is moved in the S1 direction by the gear train 182. Thus, the terminal units 130 are moved from the cam top portions 184A to the cam bottom portions 184B. Accordingly, each terminal unit 130 is moved downward in the apparatus height direction while being guided by the sliding surface 164. When the operation lever 180 is rotated in the L2 direction to set the photoconductor units 32 to the fixed state, the linear cam 184 is moved in the S2 direction by the gear train 182. Thus, the terminal units 130 are moved from the cam bottom portions 184B to the cam top portions 184A. Accordingly, each terminal unit 130 is moved upward in the apparatus height direction while being guided by the sliding surface 164.

Operation

The operation of the terminal contact structure 200S according to the present exemplary embodiment will now be described with reference to FIGS. 7A to 7C.

The terminal contact structure 200S according to the present exemplary embodiment separates the substrate terminals 240 and the apparatus body terminals 140 from each other when the photoconductor units 32 are in the removable state, and brings the substrate terminals 240 and the apparatus body terminals 140 into contact with each other when the photoconductor units 32 are in the fixed state. An example in which one of the photoconductor units 32 is inserted into the housing 120 will now be described.

(1) Insertion of Photoconductor Unit

The photoconductor unit 32 is attached to the housing 120 by inserting the photoconductor unit 32 into an attachment section corresponding to the toner color of the photoconductor unit 32. As described above, the removable state needs to be established to enable the insertion of the photoconductor unit 32. In other words, before the photoconductor unit 32 is inserted, the operator rotates the operation lever 180 in the L1 direction (see FIG. 6) to separate the image carriers 42 from the transfer belt 52. Accordingly, the photoconductor unit 32 may be inserted into the housing 120 without causing the image carrier 42 thereof to come into contact with the transfer belt 52. When the operation lever 180 is rotated in the L1 direction, each of the terminal units 130 is lowered (see FIG. 7A).

When the operator inserts the photoconductor unit 32 into the housing 120 and the holder portion 260 of the photoconductor unit 32 reaches a corresponding receiving portion 160, the outer wall surface 262 of the holder portion 260 comes into contact with the guide surface 162 of the receiving portion 160. More specifically, at each end of the holder portion 260 in the apparatus width direction, the lower wall surface of a lower portion of the holder portion 260 comes into contact with the lower guide surface 162A. In addition, the side wall surface of a side portion of the holder portion 260 comes into contact with the side guide surface 162B, and the upper wall surface of an upper portion of the holder portion 260 comes into contact with the upper guide surface 162C. Thus, the holder portion 260 is inserted into the receiving portion 160 while being guided by the guide surface 162.

The outer wall surface 262 of the holder portion 260 includes oblique surfaces that oppose each other and approach each other toward the back end in the apparatus depth direction (see FIGS. 2 and 3). The guide surface 162 of the receiving portion 160 includes oblique surfaces that oppose each other and approach each other toward the front end in the apparatus depth direction (see FIG. 4). Accordingly, even when the holder portion 260 and the receiving portion 160 are displaced from each other, the holder portion 260 may be guided into the receiving portion 160.

The ribs 222 provided on the photoconductor unit 32 are inserted into the groove portions 168 formed in the receiving portion 160. More specifically, the central rib 222A is inserted into the central groove portion 168A, and the side ribs 222B are inserted into the side groove portions 168B (see FIG. 5).

Figure 7A:
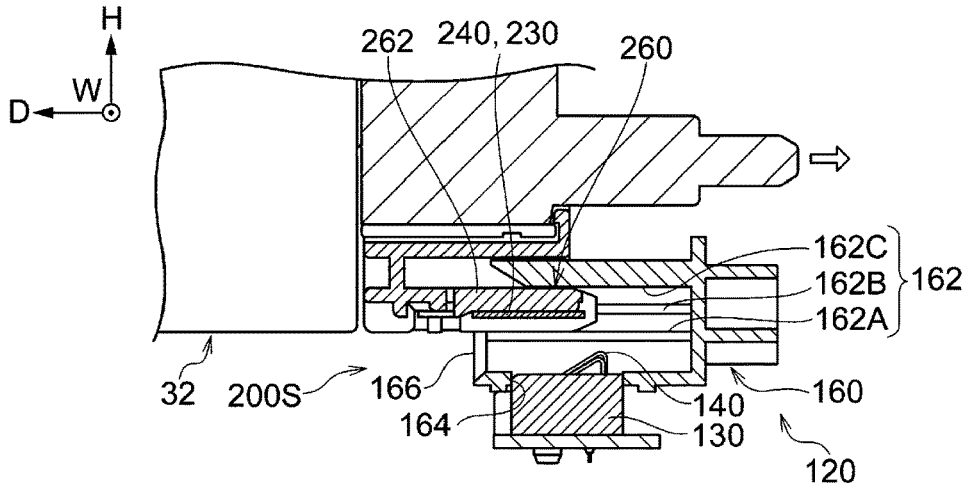
FIGS. 7A to 7C illustrate the operation of the terminal contact structure according to the exemplary embodiment, where
Figure 7B:
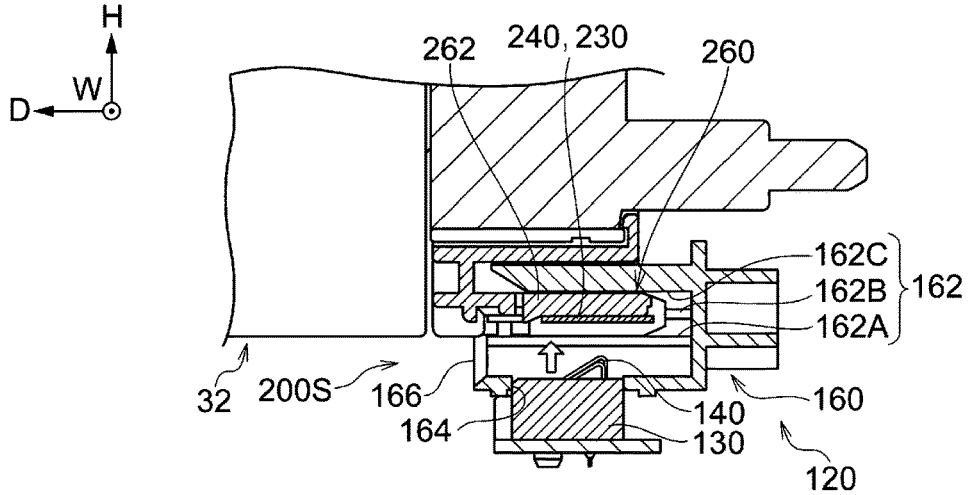

When the photoconductor unit 32 is inserted to the back end of the housing 120, as illustrated in FIG. 7B, the holder portion 260 is received by the receiving portion 160. The number and lengths of the ribs 222 and the number and lengths of the groove portions 168 that correspond to the ribs 222 differ depending on the model of the image forming apparatus 10 and the toner color. Therefore, unless the ribs 222 correspond to the same model and toner color as the groove portions 168, the ribs 222 cannot be completely inserted into the groove portions 168, and therefore the photoconductor unit 32 cannot be inserted to the back end of the housing 120.

(2) Connection of Terminals

When the photoconductor unit 32 is inserted to the back end of the housing 120, the operator rotates the operation lever 180 in the L2 direction to set all of the photoconductor units 32 to the fixed state. Accordingly, the image carriers 42 come into contact with the transfer belt 52. When the operation lever 180 is rotated in the L2 direction, each terminal unit 130 is raised (see FIG. 7C). When each terminal unit 130 is raised, the apparatus body terminal 140 thereof comes into contact with the substrate terminal 240 in each receiving portion 160. As described above, the electrodes of the apparatus body terminal 140 are formed of metal plates that project upward when viewed in the apparatus width direction. The apparatus body terminal 140 is flexible, and is pressed against the substrate terminal 240 when the apparatus body terminal 140 comes into contact with the substrate terminal 240. Thus, the terminals may be reliably connected.

Figure 7C:
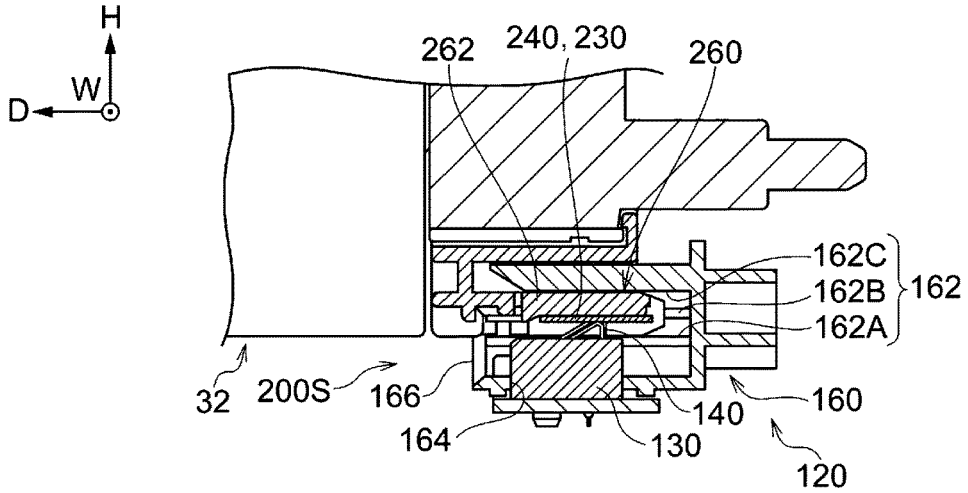

When the photoconductor units 32 are to be removed, the steps illustrated in FIGS. 7A to 7C are performed in the opposite order.

Summary

The terminal contact structure 200S according to the present exemplary embodiment has the following feature. That is, the terminal contact structure 200S according to the present exemplary embodiment includes the substrate terminals 240 provided on the photoconductor units 32 and the apparatus body terminals 140 provided on the housing 120 in which the photoconductor units 32 are inserted. The apparatus body terminals 140 are not in contact with the substrate terminals 240 when the photoconductor units 32 are in the removable state, and are in contact with the substrate terminals 240 when the photoconductor units 32 are in the fixed state. The housing 120 is provided with the receiving portions 160. The receiving portions 160 have the guide surfaces 162 and the sliding surfaces 164. The guide surfaces 162 guide the substrate terminals 240 (holder portions 260) in the apparatus depth direction, which is the insertion direction in which the photoconductor units 32 are inserted. The sliding surfaces 164 guide the apparatus body terminals 140 (terminal units 130) in the apparatus height direction, which is a crossing direction that crosses the insertion direction of the photoconductor units 32, and which is also a contact direction in which the apparatus body terminals 140 come into contact with the substrate terminals 240.

According to the above-described feature, when the photoconductor units 32 are inserted into the housing 120, the substrate terminals 240 do not come into contact with the apparatus body terminals 140. If the photoconductor units 32 are inserted into the housing 120 while the terminals are in contact with each other, there is a risk that the metals that form the terminals will be abraded and that abrasive powder generated by the abrasion will be sandwiched between the contact portions. There is also a risk that the terminals provided on the housing will damage substrates of the CRUMs. Also, the photoconductor units 32 may pick up dust and rub the dust against the terminals provided on the housing when the photoconductor units 32 are inserted. These problems lead to a contact failure of the terminals. According to the present exemplary embodiment, the risk of contact failure of the terminals is lower than that in the structure in which the photoconductor units 32 are attached or removed while the terminals are in contact with each other.

The terminal contact structure 200S according to the present exemplary embodiment also has the following feature. That is, the terminal contact structure 200S according to the present exemplary embodiment includes the operation lever 180 that switches the photoconductor units 32 between the removable state and the fixed state. In the present exemplary embodiment, when the operation lever 180 is operated to set the photoconductor units 32 to the removable state, the substrate terminals 240 and the apparatus body terminals 140 are separated from each other. When the operation lever 180 is operated to set the photoconductor units 32 to the fixed state, the substrate terminals 240 and the apparatus body terminals 140 come into contact with each other.

According to the above-described feature, the photoconductor units 32 may be more easily attached and removed than in the case where the process of switching the photoconductor units 32 between the removable state and the fixed state is performed independently. More specifically, since it is not necessary to perform both the operation of switching the photoconductor units 32 between the removable state and the fixed state and the operating of switching the terminals between the separated state and the contact state, the attaching/removing process is facilitated. In the present exemplary embodiment, the terminals are switched between the separated state and the contact state in response to the movement of the operation lever 180 for switching the photoconductor units 32 between the removable state and the fixed state. However, the operation of switching the terminals between the separated state and the contact state is not limited to this, and may instead be performed in response to, for example, movement of a handle operated when the developing units (developing devices 46) are attached or removed or an opening/closing movement of a front covering that covers the front side of the housing 120.

The terminal contact structure 200S according to the present exemplary embodiment also has the following feature. That is, the terminal contact structure 200S according to the present exemplary embodiment includes the linear cam 184 that moves the apparatus body terminals 140 in the apparatus height direction, which is the crossing direction that crosses the insertion direction of the photoconductor units 32. The linear cam 184 is linearly moved in response to the rotation of the operation lever 180.

According to the above-described feature, unlike the case where the linear cam 184 is not provided, the terminals may be switched between the separated state and the contact state by using a simple structure. In particular, according to the present exemplary embodiment, plural apparatus body terminals 140 may be simultaneously switched by using the linear cam 184. Accordingly, it is not necessary to provide the terminal contact structure 200S for each of the photoconductor units 32. In addition, unlike the case where an electric motor, an actuator, etc., are used, the terminals may be switched between the separated state and the contact state by using only a mechanical structure. Therefore, the manufacturing cost is reduced.

The terminal contact structure 200S according to the present exemplary embodiment also has the following feature. That is, each apparatus body terminal 140 (terminal unit 130) is fitted to the sliding surface 164 that surrounds the apparatus body terminal 140 (terminal unit 130) when the terminal unit 130 is at the lowered position (see FIG. 7A) in the removable state and when the terminal unit 130 is at the raised position (see FIG. 7C) in the fixed state.

In the case where the terminal units 130 are configured to become separated from the receiving portions 160 when the photoconductor units 32 are set to the removable state so that the terminal units 130 are lowered, an additional component for supporting and guiding the terminal units 130 is necessary. According to the above-described feature, the number of components for guiding the apparatus body terminals 140 is smaller than that in the case where each apparatus body terminal 140 is not fitted to the sliding surface 164 in the removable state and the fixed state. Accordingly, the manufacturing cost may be reduced.

The terminal contact structure 200S according to the present exemplary embodiment also has the following feature. That is, the terminal contact structure 200S according to the present exemplary embodiment includes the holder portions 260 that are provided on the photoconductor units 32 and that hold the substrate terminals 240 (CRUMs 230). The receiving portions 160 have the openings 166 that receive the holder portions 260 when the photoconductor units 32 are inserted. The outer wall surfaces 262 of the holder portions 260 that extend in the insertion direction come into contact with the guide surfaces 162 of the receiving portions 160.

In the terminal contact structure 200S according to the present exemplary embodiment, the holder portions 260 and the receiving portions 160 form connectors. Accordingly, the substrate terminals 240 and the apparatus body terminals 140 are disposed in the receiving portions 160 when they are connected to each other. When the substrate terminals 240 and the apparatus body terminals 140 are exposed in the housing 120, the toner dispersed in the housing 120 and foreign matter, such as dust, easily enter a contact section in which the terminals are in contact. Therefore, there is a risk that the foreign matter will adhere to and contaminate the terminals when the photoconductor units 32 are attached. In contrast, according to the above-described feature, the risk that the foreign matter or the like will reach the terminals is lower than that in the case where the outer wall surfaces 262 of the holder portions 260 that extend in the insertion direction are not in contact with the guide surfaces 162.

The terminal contact structure 200S according to the present exemplary embodiment also has the following feature. That is, the terminal contact structure 200S according to the present exemplary embodiment includes the ribs 222 that connect the housings 220 of the photoconductor units 32 to the holder portions 260. The ribs 222 extend in the apparatus depth direction, which is the insertion direction of the photoconductor units 32. The receiving portions 160 have the groove portions 168 formed in the upper wall surfaces, which constitute the guide surfaces 162, so as to extend in the apparatus depth direction. The ribs 222 are inserted into the groove portions 168.

As described above, unless the ribs 222 correspond to the same model and toner color as the groove portions 168, the ribs 222 cannot be completely inserted into the groove portions 168, and therefore the photoconductor units 32 cannot be inserted to the back end of the housing 120 (see FIG. 7B). Thus, unlike the case in which the ribs 222 are not inserted into the groove portions 168 in the receiving portions 160, the photoconductor units 32 may be prevented from being inserted into attachment sections that do not correspond thereto by mistake.

The image forming apparatus 10 according to the present exemplary embodiment has a feature that the photoconductor units 32 are provided as removable bodies that are removably attached to the housing 120. The photoconductor units 32 are provided with the terminal contact structure 200S.

According to the above-described feature, the risk of malfunction of the image forming apparatus unit is lower than that in an image forming apparatus in which the image forming apparatus unit is attached and removed while the terminals are in contact with each other.

According to the present exemplary embodiment, the apparatus body terminals 140 and the substrate terminals 240 are not in contact with each other when the photoconductor units 32 are in the removable state, and are in contact with each other when the photoconductor units 32 are in the fixed state. This feature may be combined with the above-described features without limitation.

In the terminal contact structure 200S according to the present exemplary embodiment, the terminals are connected together at the back of each photoconductor unit 32 in the apparatus depth direction, and at the bottom of each photoconductor unit 32 in the apparatus height direction. However, the position at which the terminals are connected is not limited to this. For example, a terminal may be provided on a side surface of each photoconductor unit 32, or a front surface of the photoconductor unit 32, that is, a surface at the back of the photoconductor unit 32 in the apparatus depth direction. Thus, the position at which the terminals are connected is not limited as long as the terminals may be switched between the separated state and the contact state.

Although the terminal contact structure 200S according to the present exemplary embodiment is provided between the housing 120 and the photoconductor units 32, the terminal contact structure 200S is not limited to this. For example, the terminal contact structure 200S may instead be provided between the housing 120 and the developing units (developing devices 46) or between the housing 120 and the toner cartridges of the supplying mechanism 22.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A terminal contact structure comprising:

a first terminal provided on a removable body;

a second terminal provided on an apparatus body in which the removable body is inserted, the second terminal not being in contact with the first terminal when the removable body is in a removable state, the second terminal being in contact with the first terminal when the removable body is in a fixed state;

a guide member provided on the apparatus body and having a first surface and a second surface, the first surface guiding the first terminal in an insertion direction in which the removable body is inserted, the second surface guiding the second terminal in a contact direction in which the second terminal comes into contact with the first terminal, the contact direction being a crossing direction that crosses the insertion direction; and a lever that switches the removable body between the removable state and the fixed state, wherein the first terminal and the second terminal are separated from each other when the lever is operated to set the removable body to the removable state, and are brought into contact with each other when the lever is operated to set the removable body to the fixed state.

2. The terminal contact structure according to claim 1, further comprising:

a linear cam that moves the second terminal in the crossing direction, wherein the linear cam linearly moves in response to a rotation of the lever.

3. The terminal contact structure according to claim 1, wherein the second terminal is fitted to the second surface that surrounds the second terminal when the removable body is in the removable state and when the removable body is in the fixed state.

4. The terminal contact structure according to claim 2, wherein the second terminal is fitted to the second surface that surrounds the second terminal when the removable body is in the removable state and when the removable body is in the fixed state.

5. The terminal contact structure according to claim 1, further comprising:

a holder that is provided on the removable body and that holds the first terminal, wherein the guide member has an insertion hole that receives the holder when the removable body is inserted, and wherein the holder has a surface that extends in the insertion direction and that is in contact with the first surface of the guide member.

6. The terminal contact structure according to claim 2, further comprising:

a holder that is provided on the removable body and that holds the first terminal, wherein the guide member has an insertion hole that receives the holder when the removable body is inserted, and wherein the holder has a surface that extends in the insertion direction and that is in contact with the first surface of the guide member.

7. The terminal contact structure according to claim 3, further comprising:

a holder that is provided on the removable body and that holds the first terminal, wherein the guide member has an insertion hole that receives the holder when the removable body is inserted, and wherein the holder has a surface that extends in the insertion direction and that is in contact with the first surface of the guide member.

8. The terminal contact structure according to claim 4, further comprising:

a holder that is provided on the removable body and that holds the first terminal, wherein the guide member has an insertion hole that receives the holder when the removable body is inserted, and wherein the holder has a surface that extends in the insertion direction and that is in contact with the first surface of the guide member.

9. The terminal contact structure according to claim 5, further comprising:

a rib that connects a body portion of the removable body to the holder and that extends in the insertion direction, wherein the first surface of the guide member has a groove that extends in the insertion direction and in which the rib is inserted.

10. The terminal contact structure according to claim 6, further comprising:

a rib that connects a body portion of the removable body to the holder and that extends in the insertion direction, wherein the first surface of the guide member has a groove that extends in the insertion direction and in which the rib is inserted.

11. The terminal contact structure according to claim 7, further comprising:

a rib that connects a body portion of the removable body to the holder and that extends in the insertion direction, wherein the first surface of the guide member has a groove that extends in the insertion direction and in which the rib is inserted.

12. The terminal contact structure according to claim 8, further comprising:

a rib that connects a body portion of the removable body to the holder and that extends in the insertion direction, wherein the first surface of the guide member has a groove that extends in the insertion direction and in which the rib is inserted.

* * * * *